United States Patent [19]

Strehlow

[11] Patent Number: 4,753,533

[45] Date of Patent: Jun. 28, 1988

[54] FLY ASH BATCHER AND MIXER

[75] Inventor: Robert W. Strehlow, New Berlin, Wis.

[73] Assignee: Mixer Systems, Inc., Menomonee Falls, Wis.

[21] Appl. No.: 773,588

[22] Filed: Sep. 9, 1985

[51] Int. Cl.[4] ..... B01F 7/08; B28C 7/14

[52] U.S. Cl. ..... 366/151

[58] Field of Search ..... 366/151, 152, 154

[56] References Cited

U.S. PATENT DOCUMENTS

| | | | |
|---|---|---|---|
| 3,591,147 | 7/1971 | Anderson et al. | 366/151 X |
| 3,697,052 | 10/1972 | Andris | 366/152 X |
| 4,123,175 | 10/1978 | Carlson et al. | 366/151 |

*Primary Examiner*—Robert R. Mackey

*Attorney, Agent, or Firm*—George A. Evans

[57] ABSTRACT

A volumetric batcher is combined with a batch mixer so that similiar batches of powdered fluidizable material such as fly ash can be mixed with constant quantities of water resulting in mixtures having the same moisture. This enables their disposal at a land fill site or the like. To insure that the material in the batcher is settled to the desired degree before the inlet valve is closed, a high level indicator is provided which jogs the inlet valve to retard the rate of flow and this valve is allowed to continue to jog until a short period of time has elapsed during which the high level probe is constantly under the influence of the fly ash, at which time it is completely closed. Additional means are provided for insuring complete discharge from the batcher, measuring and timing the flow of water and removing air from the mixer and batcher during charging operations.

5 Claims, 3 Drawing Sheets

FLY ASH BATCHER AND MIXER

BACKGROUND OF THE INVENTION

This invention deals with the disposition of fly ash produced when coal is burned in installations such as electric power generating plants. Due to its properties, fly ash is difficult to dispose of primarily because of its tendency to dust and the difficulty of preventing such dust from getting into the atmosphere and creating an environmental hazard.

It has been common practice to moisten the ash with suitable quantity of water or other liquid and after mixing the two, to dispose of the mixture at a sanitary land fill or similiar place of disposal.

A discussion of the problems of creating a satisfactory mixture of liquid and fly ash is contained in U.S. Pat. No. 4,472,198, issued Sept. 18, 1984. As pointed out in this patent, if the ash is insufficiently moistened, dust is still generated and can escape into the atmosphere, whereas if excessive liquid is mixed with the ash, the mixture is difficult to transport and otherwise handle.

U.S. Pat. No. 4,472,198 describes the batching of measured quantities of fly ash and water, and mixing them in a batch mixer to produce mixed batches of fly ash sludge. This patent fails to reveal the necessary apparatus and procedure to produce in a commercial manner, a uniform end product.

It is an object of this invention to provide apparatus that will produce in a reliable manner large quantities of disposable moisturized fly ash material.

A further object is to reduce the time required to produce mixed batches of the resultant sludge and to insure uniform quality from batch to batch.

SUMMARY OF THE INVENTION

The mixer used to blend the moisture with the fly ash is of the type disclosed in my U.S. Pat. No. 4,506,984 issued Mar. 26, 1985. Very little alteration is required to adapt this type of batch mixer to the present use. Combined with the mixer is a volumetric bin or batcher which measures the required amount of fly ash for each batch to be mixed along with a means to measure an amount of water to ensure the proper final liquidity or cohesiveness of the material produced.

The batching system is cycled automatically so that while the mixer is mixing, the batcher is being loaded and as soon as the batch is suitably mixed and discharged from the mixer, a properly measured quantity of fly ash is ready for discharge from the batcher into the mixer.

The discharge of water into the mixer is coordinated with passage of dry material into the inlet opening of the mixer. The quantity of water will vary with the type of fly ash being treated but in all cases can be fed at a rate to insure complete introduction prior to the completion of the mixing cycle.

To insure the batcher is completely filled so that the quantities of material will not vary from batch to batch, probes are used which are actuated by contact with the fly ash as it reaches prescribed levels in the batcher. Valves disposed in the inlet passage to the batcher and the passage from the batcher to the mixer are operated in sequence during the operation cycle. The inlet valve is preferably of the type that can be "jogged" to allow slower feeding of material as the requisite level is approached. Accordingly, the lower of the two probes in the upper portion of the batcher is used to start the jogging of the inlet valve. The higher probe causes the valve to completely close, but it is significant that complete closure of the valve is retarded and the jogging is continued a sufficient time after the upper probe is actuated to allow the material in the batcher to settle, and for some of the air entrained in the ash to escape, thus insuring a full batch is being measured.

Actually the probe which eventually causes closure of the batcher inlet valve has a timer which requires the powder be in constant contact with the probe for the time set on the full probe timer, generally in the range of three to four seconds. If due to settlement of the powder, the probe is uncovered prior to expiration of this period of time, the filling gate is again opened introducing more powder and the full timer is again reset.

Any shrinkage which occurs after the expiration of the timer does not affect the amount of material introduced into the batcher because the gate has now been closed and the desired batch has been measured.

The time allowed for settling of the fly ash powder enables escape of sufficient entrained air with the result that the settled fly ash has a density that does not vary materially from batch to batch. This time also enables the level of the ash to stablize so that measurements are made while the material is in a static state. As a result the size of the batches can be repeated and if the same amount of water is added for each batch, the final moisture will be consistent.

While this form of control is not as accurate as when batches are weighed, where an accuracy of plus or minus one percent may be specified, it is accurate enough for present purposes and is much more economical and more rapid in its operation. Experience has indicated it is possible to maintain the variation in size of batches to be in the range of about five percent, which insures the final moisturized end product is acceptable for disposal purposes.

Equally important with accurate filling of the batcher is the complete discharge of the batcher contents to maintain consistant size of batches. Accordingly, when the gate between the batcher and the mixer is opened, air is introduced through bin pads to assist in discharge of fly ash from the batcher. When the material in the batcher reaches a level uncovering the empty level probe, a bin vibrator is actuated which prevents bridging of the material in the throat of the batcher and assists in its discharge.

The system is sealed to prevent escape of fly ash during any portion of its passage through the equipment. During charging of the mixer, air is vented from the mixer to the batcher thus avoiding the build up of pressure in the mixer. During charging of the batcher, air is vented from the batcher to the fly ash holding silo or to the bag house; a check valve in the vent from the mixer to the batcher prevents flow of air from the batcher to the mixer during charging of the batcher.

It is essential that the batcher be completely filled, and completely emptied, during each cycle of the systems operation. Otherwise the quantity of water used will not produce the required density of the final product. It is also essential that the flow of the material into the batcher be shut off when the proper volume has been reached to insure a constant solids content.

DESCRIPTION OF THE PREFERRED EMBODIMENT

Figure 1:
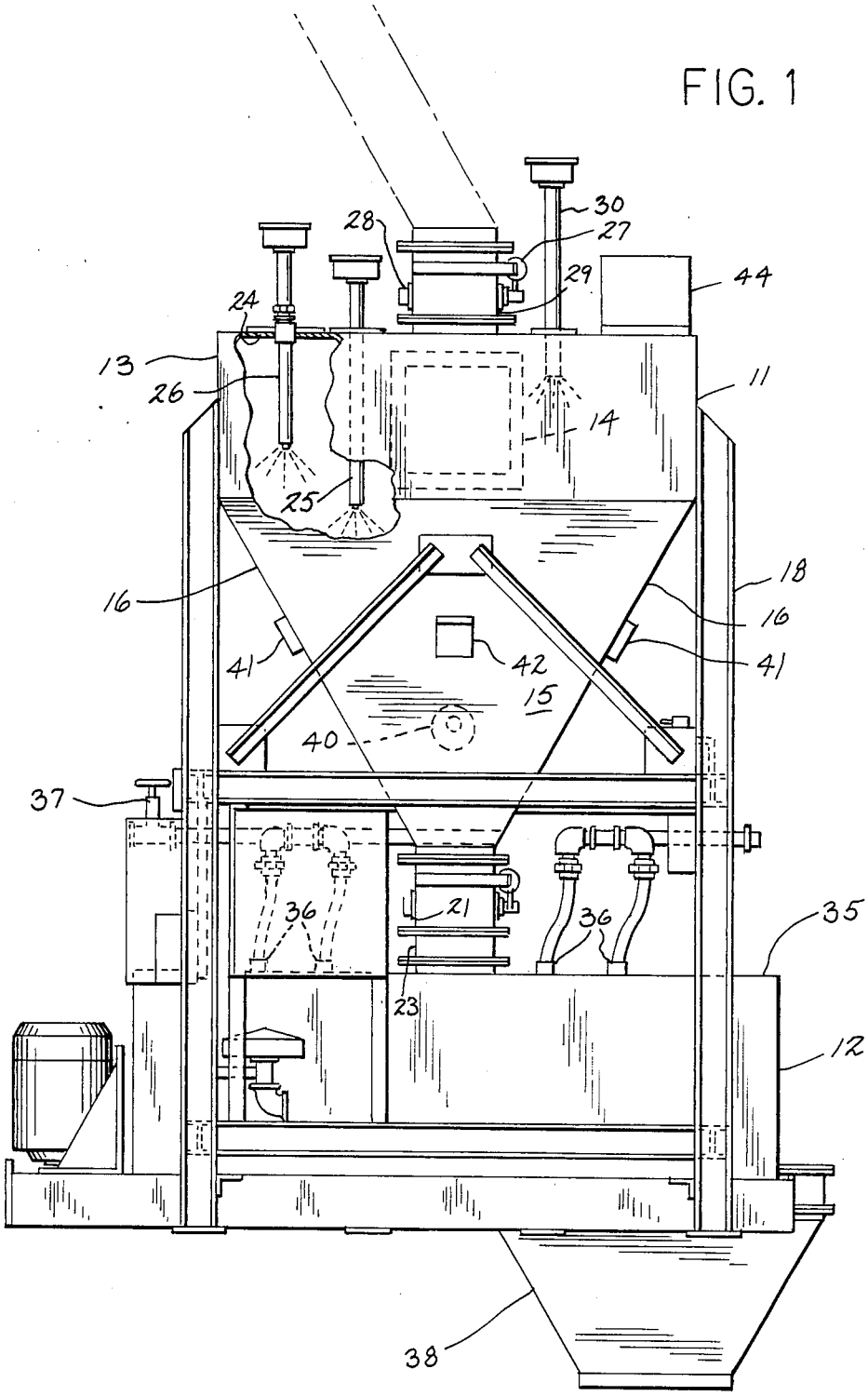
FIG. 1 is a front view of the combined batching and mixer package.
Figure 2:
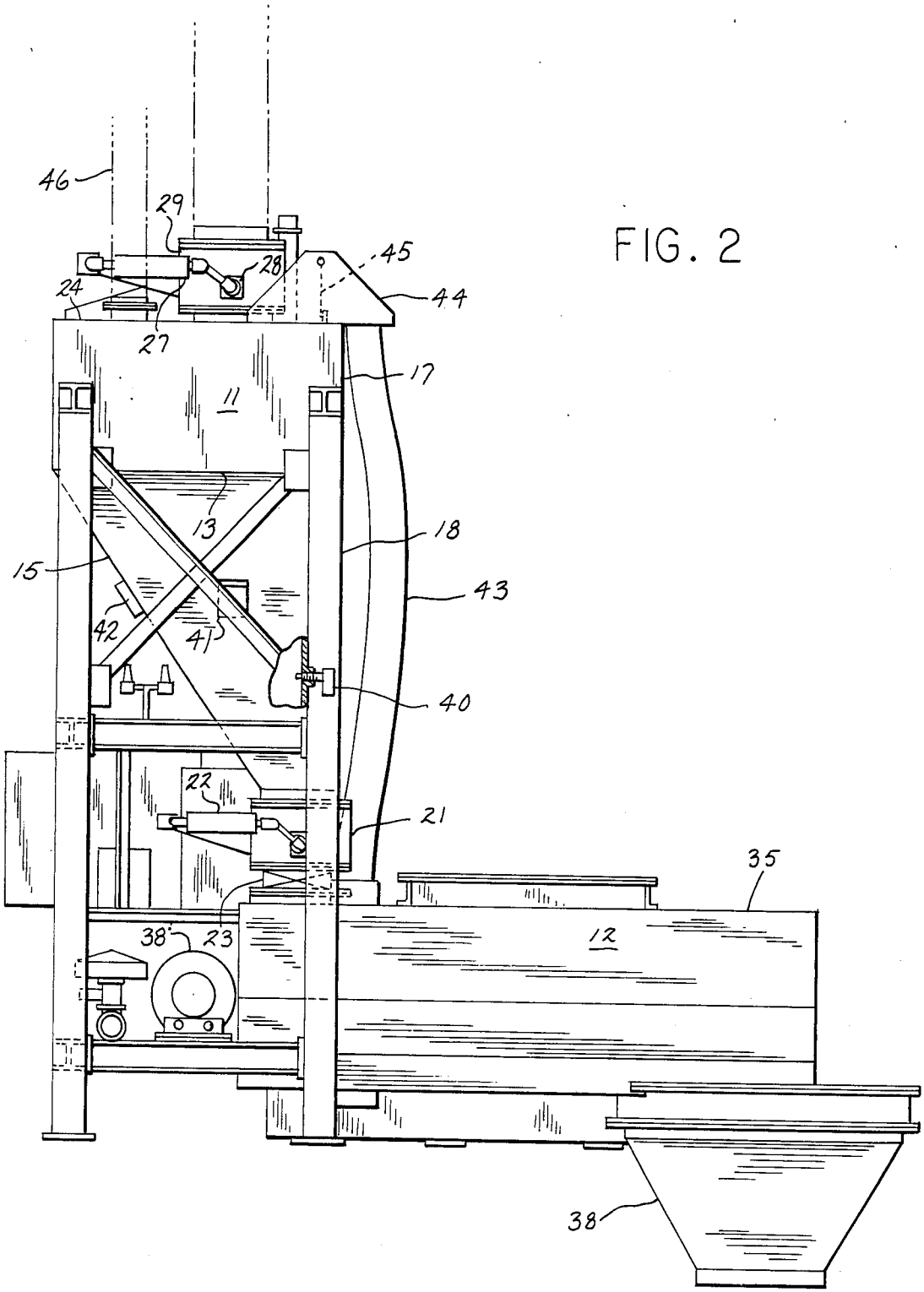
FIG. 2 is a side elevation of the apparatus shown in FIG. 1.

The drawings generally depict the arrangement of the batcher 11 above one side of the mixer 12. As shown in FIGS. 1 and 2, the batcher has a rectangular upper section 13 which is provided with a window 14 through which the level of the fly ash can be viewed. The lower position of the batcher has three sides that taper downwardly, the slope of the front side 15 being roughly similar to the slope of the two end sides 16. The back side 17 is vertical. Suitable framework 18 provides support for the batcher with the legs resting on the ground or any suitable support for the batcher and mixer. If the mixer is to discharge into a truck, the mixer and the batcher are mounted on a platform under which the truck can be driven to receive one or more mixed batches of moistened fly ash material.

The outlet at the lower end of the batcher 11 communicates with a gate 21 which in this instance includes a rotary plug valve actuated by the air cylinder 22. The lower end of the gate is connected to the inlet of the mixer by means of a dust boot 23 which accommodates any misalignment vertically or laterally between the bin and the mixing chamber.

As shown in the broken away section in FIG. 1, extending through the top 24 of the batcher are two probes 25 and 26, the probe 25 extending to a lower level than the probe 26.

The probes 25 and 26 are utilized to produce signals indicating the presence of material within their range. They are solid state capacitance probes of a type commonly used for this type of application. The probes actuate power relays which in turn are utilized to operate the air cylinder 27 that oscillates the rotary valve 28 located in the inlet gate 29.

Referring to the probe 25, the presence of fly ash in the batcher reaching a level to which the probe responds will cause the valve 28 to be "jogged", i.e. oscillated between an open and closed position. This retards the passage of material through the gate and enables it to be closed with more accurate cut-off at the end of the charging cycle.

The probe 26 serves to indicate when the level of material reaches its elevation that the oscillation of the valve 28 should cease and complete closure should occur. It has been observed, however, that even when this probe is actuated, the material in the batcher continues to settle and therefor, jogging of the valve should be continued for up to three or four seconds, with the result that entrained air is removed, variations in density are eliminated and more uniform quantity of fly ash is measured from batch to batch. Consequently more uniform quantity of moisture will be obtained in the final mixtures of different batches.

To prevent failure of the probe 26 to cause closure of the valve 28, an over fill probe 30 is also provided which is used only as an emergency to protect against malfunction of probe 26.

As previously mentioned, the mixer 12 is of the type described in my U.S. Pat. No. 4,506,984. Material is introduced from the dust boot 23 through an opening in the cover 35 on the top of the mixer. This opening is off to one side and is sealed to prevent escape of dust. Also passing through the cover are the pipes 36 that provide water to the nozzles that discharge water over different areas of the surface of the batch being accumulated in the mixer. It is important that water be supplied concurrently with the charging of the mixer and be continued until after all material is in the mixer so that the portions of the rotating blades in the mixer which extend above the batch can be flushed to prevent build up of material. Flow through the pipes 36 can be staggered so that water can be evenly distributed in different parts of the mixer and the final rate of flow for instance through two of the pipes can be reduced prior to final closure of the measuring valve controlling the flow through the pipe supplying the last amount of water. In addition to the measuring valves which are shut when the requisite quantity of water has been supplied, there is the hand valve 37 for shut off and drainage of the water system. In the system here described, there are two solenoid flow control valves, each serving two nozzles with the timing of one slightly over-lapping the period of discharge from the other.

The mixer is provided with the customary discharge gate, as shown in U.S. Pat. No. 4,165,185, which is swung across the opening in the hopper 38 to permit discharge when the gate is opened and to prevent such discharge when the gate is closed. There is no danger of unmixed fly ash escaping to the atmosphere through this gate since the gate is only opened after the fly ash is properly mixed.

To facilitate discharge of fly ash from the batcher 11, the sloping walls 15 and 16 are provided with bin flow pads 41 introduce low pressure, fluidizing air along the inner sides of the sloping walls in a well known manner. The blower 38' supplying air to the flow pads 41 is started at the same time that the gate 21 is opened. When the level has dropped to a point exposing the probe 40 which extends through the lower portion of the vertical wall 15 of the batcher, a vibrator 42 mounted on the outside of the batcher starts to vibrate. This prevents bridging of the fly ash in the throat of the batcher After a suitable time, the vibrator stops, the blower is turned off and the gate 21 is closed.

During the charging of the mixer, air is vented from the top of the mixer through the hose 43 to the fitting 44 on the top of the batcher. In this fitting is a check valve 45 which enables air to be vented from the mixer to the batcher, but which prevents movement of air in the opposite direction from the batcher to the mixer. Instead, when the batcher is being charged, air is vented to either the silo from which the fly ash is supplied, or to the bag house. A suitable hose 46 is provided for this purpose.

Figure 3:
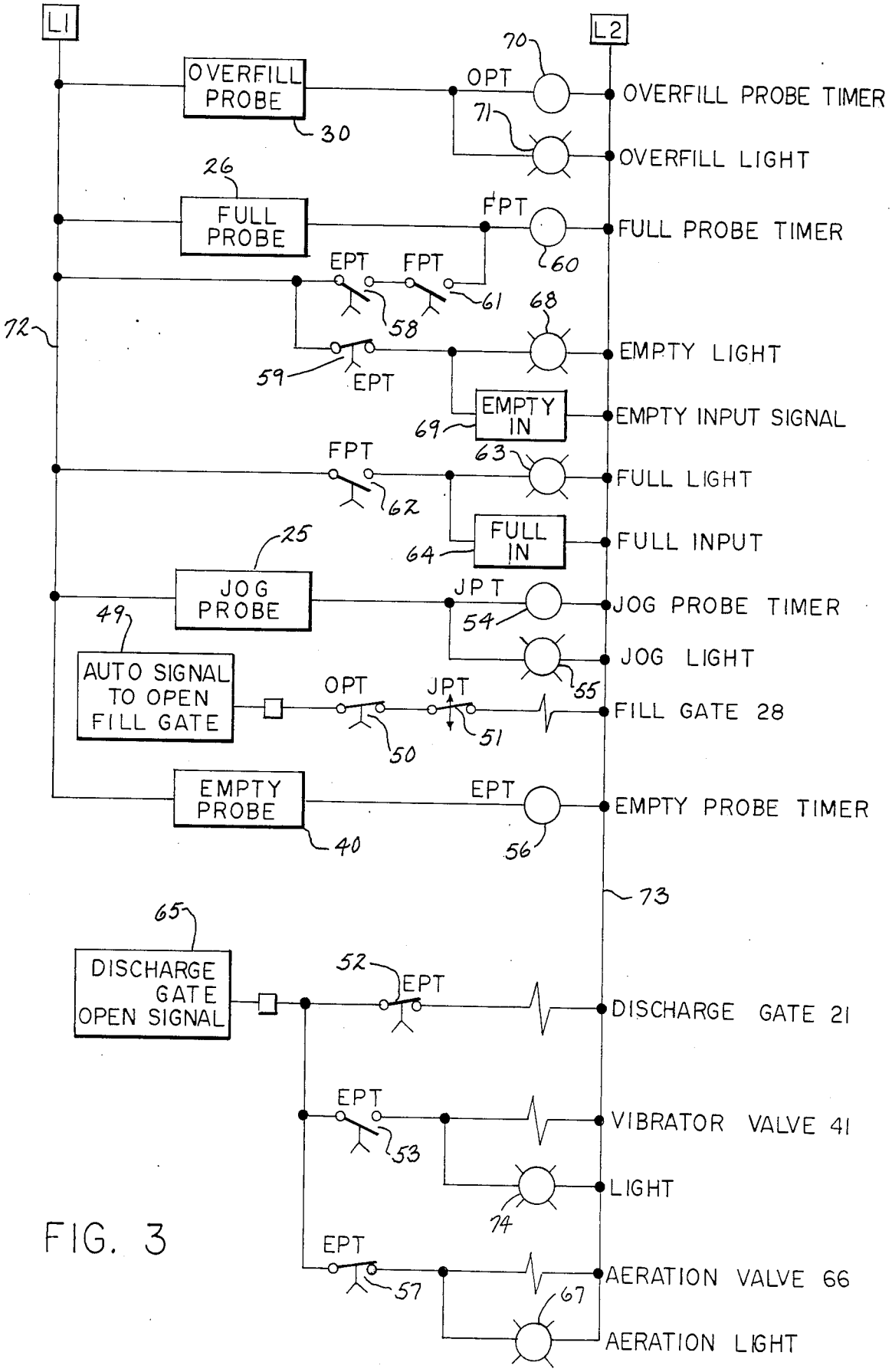
FIG. 3 is a schemating wiring diagram for controlling the level of ash in the volumetric batcher.

Referring now to FIG. 3, there is shown a schematic wiring diagram for controlling the above described components. In operation, and assuming that batcher 11 is completely empty and ready to start a new cycle, a signal from terminal 49 of a main controller such as a programmable controller passes through normally closed overfill probe timer relay 50 and then through normally closed jog probe timer relay 51 to open fill gate 28. Upon the opening of gate 28, fly ash flows into the batcher in a fill operation. As fly ash flows into the batcher, the fly ash eventually completely covers empty probe 40. At this time empty probe 40 closes normally closed empty probe timer relay 52 and opens normally open empty probe timer relay 53 in preparation for later discharge as will hereinafter be described. An empty probe timer 56 is reset at the same time relay 52 is closed and relay 53 is opened, and a normally closed empty probe timer relay 57 is closed. Also, a normally open empty probe timer relay 58 is closed and a normally closed empty probe timer relay 59 is opened.

Fly ash continues to flow into batcher 11 until it reaches jog probe 25. At this point, jog probe 25 activates jog probe timer 54 and activates jog light 55 to indicate to an operator that jogging is taking place. As jog probe timer 54 cycles, it causes relay 51 to continuously pulse on and off depending upon the cycle time of timer 54. Thus, fill gate 28 jogs open and closed depending upon the pulse from timer 54 to slow the flow of fly ash into the batcher.

When the fly ash inside the batcher reaches full probe 26, full probe 26 actuates a full probe timer 60 which in turn closes a normally open full probe timer relay 61. At the same timer timer 60 also closes a normally open full probe timer relay 62. Should the full probe 26 become uncovered, due to settling of the fly ash or otherwise, prior to the end of the timing period of the timer 60, the timer is reset and can complete its timing cycle cnly if the probe remains covered during the full timing period.

After receiving the full input signal from terminal 64, the main controller automatically sends a discharge signal through terminal 65 to open discharge gate 21. Since relay 52 had previously been closed by the covering of empty probe 40, the signal from terminal 65 reaches discharge gate 21 and opens gate 21. At the same time the discharge gate open signal passes through relay 57, which was previously closed by the covering of empty probe 40, to cause the aeration valve 66 to open so that the fly ash within the batcher is aerated to aid in its discharge. At the same time an aeration light 67 is energized to indicate to an operator that aeration is taking place.

Discharge gate 21 remains open as the fly ash is discharged, and once the level of the fly ash inside the batcher uncovers empty probe 40, empty probe 40 energizes timer 56 which in turn immediately closes relay 53 to begin operation of vibrator valve 41. At the same time a vibrator light 74 is energized to indicate to an operator that vibration is occurring. During the predetermined cycle time of timer 56, the batcher is vibrated to shake loose any fly ash that may be caught on the sides of batcher while at the same time the fly ash continues to discharge through gate 21. At this time, timer 56 also opens relay 57 to close aeration valve 66, turn off light 67 and stop aeration. At the end of the predetermined cycle time for timer 56, timer 56 opens relay 52 and relay 53 to close the discharge gate 21 and vibrator valve 41, respectively. Fly ash discharge and vibration of batcher is thus stopped. At the same time, timer 56 closes relay 58 which in turn energizes a light 68 through relay 59 indicating to an operator that batcher is empty. Also, a signal is sent through terminal 69 to the automatic main controller to indicate that batcher is empty. The main controller then sends a signal through terminal 49 to open fill gate 28 as previously described. This cycle continues as described for any desired number of batches.

As previously described, overfill probe 30 is a safety device for shutting down the system should the batcher be overfilled for some reason. As shown in FIG. 3, if fly ash within the batcher reaches overfill probe 30, probe 30 actuates an overfill probe timer 70 and at the same time energizes a light 71 to indicate to an operator that there is an overfill condition. Upon the actuation of timer 70, timer 70 will open relay 50 which will interrupt the signal from the main controller to fill gate 28 and cause fill gate 28 to close. The system will thus be shut down until the cause for the over fill condition is determined and corrected.

As shown in FIG. 3, main lines 72 and 73 are connected to opposite terminals of a power source. Typically, this power source is a 120 volt, single phase, 60 Hz power source which is conventionally available.

The following time cycle is typical of the operation of the equipment. During the first 20 seconds of the cycle after the starting signal, the batcher is filled. Assuming the average batch consists of approximately 130 cubic feet of fly ash, this charging time has been found to be reliably adequate with the equipment illustrated. An additional 20 seconds is required to discharge the batcher, with the batch vibrator being operated the last 5 seconds. Simultaneously with the discharge from the batcher, water is supplied to the mixer. There are 3 stages of water introduction, the last valve supplying water a few seconds after the discharge gate from the batcher is closed.

The mixing cycle starts simultaneously with the discharge of the batcher, but the initial part of the total 75 second mixing cycle indicated includes mixing of only a small portion of the batch and the final half of the mixing cycle which occurs during discharge from the mixer occupies nearly all of the mixer discharge cycle of 42½ seconds.

It is not necessary to discharge all the contents of mixer prior to the end of each cycle as long as a new batch of fly ash of the desired amount is introduced with the desired quantity of water, the mixer discharge gate may be closed prematurely. This allows a total time of 45 seconds except for the last batch which requires 65 seconds to completely discharge the mixer at the end of the total period of operation.

It will be noted the second and subsequent filling of the batches each is allowed 20 seconds, which results in the fly ash being held in the batcher for a portion of the mixing time in excess of the 20 second filling time. During this time, there may be further settling of the fly ash, augmented perhaps by vibration from the mixer, and it is even possible the level will disappear beneath the window 14, but such settling is of no consequence because the batch has been measured under conditions enabling subsequent batches to contain approximately the same quantity of fly ash.

Using this cycle, it should be possible to produce 130 tons of mixed material per hour. If the material weighs 50 pounds per cubic foot, 130 tons equal 5,200 cubic feet of ash. To produce this quantity would require continuous cycles of 40 batches per hour.

I claim:

1. Apparatus for moistening fly ash to condition it for disposition at a land fill or the like comprising the combination of a sealed batch mixer in which the fly ash is mixed with water and a volumetric batcher disposed above the mixer, said batcher having entrance and discharge gates controlling the entrance and discharge of fly ash being measured therein, a pair of probes arranged near the top of the batcher actuated by the presence of material in contact therewith, one of said probes being higher than the other, the lower probe including first control means responsive to material in contact with the lower probe for causing the entrance gate to jog between open and shut position, the upper probe including second control means responsive to the presence of material at a level higher than the lower probe for causing the entrance gate to be closed, but only a predetermined time after the material has first come in contact therewith to allow settling of the fly ash already in the batcher, means controlling discharge of the fly ash from the batcher to the mixer after the entrance gate has been held in closed position, and means for introducing water into the mixer simultaneously with the discharge from the batcher.

2. Apparatus according to claim 1, including means for introducing fluidizing air under pressure into the batcher as it is discharging to assist with flow of material from the batcher.

3. Apparatus according to claim 1 including a bin vibrator, control means for actuating the bin vibrator when the discharge gate is open, said vibrator preventing bridging of material in the lower portion of the vibrator.

4. Apparatus set forth in claim 1 wherein the means for introducing water into the mixer comprise control means causing water introduction to commence simultaneously with the discharge of fly ash into the mixer.

5. A volumetric batcher for measuring batches of fluidizable powdered material such as fly ash prior to mixing such batches with moisture in a batch mixer, said batcher comprising a bin with inlet and outlet openings, inlet and discharge gates controlling the flow of material through said openings, a pair of probes disposed in the upper portion of said bin, the lower of said probes including first control means responsive to the presence of material at its level to cause the inlet gate to be jogged thereby slowing down the flow of material, and an upper probe including second control means responsive to the presence of material at its level arranged to close said inlet gate, but only after the upper probe has been constantly in contact with said material for a sufficient period of time to eliminate amounts of entrained air causing variation in the volume of material occupying the space below the level of said upper probe, said second control means including a timer set to time the period during which the upper probe is covered, the uncovering of said upper probe, control means for opening the discharge gate for controlling discharge of fly ash from the batcher only after the entrance gate has been held in a closed position, a batch mixer for mixing the material so measured with a measured quantity of water and means for introducing water into the mixer simultaneously with the discharge of material from the batcher.

* * * * *